US009824655B2

(12) United States Patent
Suzuki et al.

(10) Patent No.: US 9,824,655 B2
(45) Date of Patent: Nov. 21, 2017

(54) DISPLAY DEVICE HAVING A MAIN WRITING AND ADDITIONAL WRITING PERIODS

(71) Applicant: Japan Display Inc., Minato-ku (JP)

(72) Inventors: Daiichi Suzuki, Tokyo (JP); Yukio Tanaka, Tokyo (JP); Hirofumi Wakemoto, Tokyo (JP)

(73) Assignee: Japan Display Inc., Minato-ku (JP)

( * ) Notice: Subject to any disclaimer, the term of this patent is extended or adjusted under 35 U.S.C. 154(b) by 2 days.

(21) Appl. No.: 14/991,289

(22) Filed: Jan. 8, 2016

(65) Prior Publication Data

US 2016/0210922 A1 Jul. 21, 2016

(30) Foreign Application Priority Data

Jan. 16, 2015 (JP) ..... 2015-006614

(51) Int. Cl.
*G09G 3/36* (2006.01)

(52) U.S. Cl.
CPC ..... *G09G 3/3648* (2013.01); *G09G 3/3677* (2013.01); *G09G 2310/067* (2013.01); *G09G 2320/0247* (2013.01)

(58) Field of Classification Search
CPC ..... G09G 3/3648; G09G 3/3677
USPC ..... 345/99
See application file for complete search history.

(56) References Cited

U.S. PATENT DOCUMENTS

2004/0036669 A1 2/2004 Yanagi et al.
2007/0273678 A1* 11/2007 Okita ..... G09G 3/342 345/204
2008/0198120 A1* 8/2008 Senda ..... G09G 3/3648 345/92
2009/0273555 A1* 11/2009 Song ..... G09G 3/3666 345/96
2009/0303166 A1* 12/2009 Tsubata ..... G09G 3/342 345/87
2014/0375535 A1 12/2014 Tanaka et al.

FOREIGN PATENT DOCUMENTS

JP 2011-70204 4/2011
JP 2015-4718 1/2015

* cited by examiner

*Primary Examiner* — Long D Pham
(74) *Attorney, Agent, or Firm* — Oblon, McClelland, Maier & Neustadt, L.L.P.

(57) ABSTRACT

According to one embodiment, a display device includes a display panel including a gate line, source lines, and switching elements connected to the gate line and the respective source lines. A gate driver selects the gate line. A source driver supplies an image signal to the source lines. The image signals can be supplied to pixel electrodes through the switching elements. A frame period includes a first scan period in which the gate line is selected, a first hold period subsequent to the first scan period, a second scan period in which the gate line is selected subsequent to the first hold period, and a second hold period subsequent to the second scan period. The first hold period is longer than the second hold period.

6 Claims, 6 Drawing Sheets

DISPLAY DEVICE HAVING A MAIN WRITING AND ADDITIONAL WRITING PERIODS

CROSS-REFERENCE TO RELATED APPLICATIONS

This application is based upon and claims the benefit of priority from Japanese Patent Application No. 2015-006614, filed Jan. 16, 2015, the entire contents of which are incorporated herein by reference.

FIELD

Embodiments described herein relate generally to a display device.

BACKGROUND

A technique to reduce the frame frequency is known as a method for reducing the consumed power of liquid crystal displays. For example, the following technique is suggested. A rest period in which all the scan signal lines are in a non-scan state is set between scan periods in which the screen is scanned. In the rest period, the operation of a driving circuit for driving a display portion is stopped.

On the other hand, when the frame frequency is reduced, the voltage retained by each pixel tends to change as time passes. Thus, in the displayed image, the difference in luminance may be easily recognized as a flicker because of the difference in potential between frames. In this manner, the display quality may be degraded.

DETAILED DESCRIPTION

In general, according to one embodiment, the following display device is provided. The display device comprises:

a display panel comprising including a gate line, a plurality of source lines intersecting with the gate line, and a plurality of switching elements electrically connected to the gate line and the respective source lines; and a driving portion including a gate driver which selects the gate line by supplying a predetermined voltage to the gate line, and a source driver which supplies image signals to the source lines for each frame period, wherein the image signals are supplied from the connected source lines to pixel electrodes through the switching elements connected to the gate line selected by the gate driver, the frame period comprises a first scan period in which the gate line is selected by the gate driver, a first hold period subsequent to the first scan period, a second scan period in which the gate line is selected by the gate driver at least once subsequent to the first hold period, and a second hold period subsequent to the second scan period, and the first hold period is longer than the second hold period.

Embodiments will be described with reference to the accompanying drawings. The disclosure is merely an example. Proper changes which maintain the spirit of the invention and are easily conceivable by a person of ordinary skill in the art are included in the scope of the present invention as a matter of course. To further clarify the explanation, the drawings may exemplarily show the width, thickness, shape, etc., of each portion in comparison with the actual aspect. However, the drawings are merely examples and do not restrict the interpretation of the present invention. In the specification and drawings of this application, elements which fulfill a function identical with or similar to those in the already described drawings may be denoted by the same reference numbers or symbols, and their overlapping detailed descriptions may be arbitrarily omitted.

In the following embodiments, a liquid crystal display device is disclosed as an example of a display device. The liquid crystal display device can be used for various types of devices such as a smartphone, a tablet, a mobile phone, a personal computer, a television receiver, an in-car device and a games console. The main structures disclosed in the embodiments may be also applied to, for example, an auto-luminous light-emitting display device comprising an organic electroluminescent display element, etc., an electronic paper display device comprising an electrophoretic element, a display device to which micro-electromechanical systems (MEMS) are applied, or a display device to which electrochromism is applied.

Figure 1:
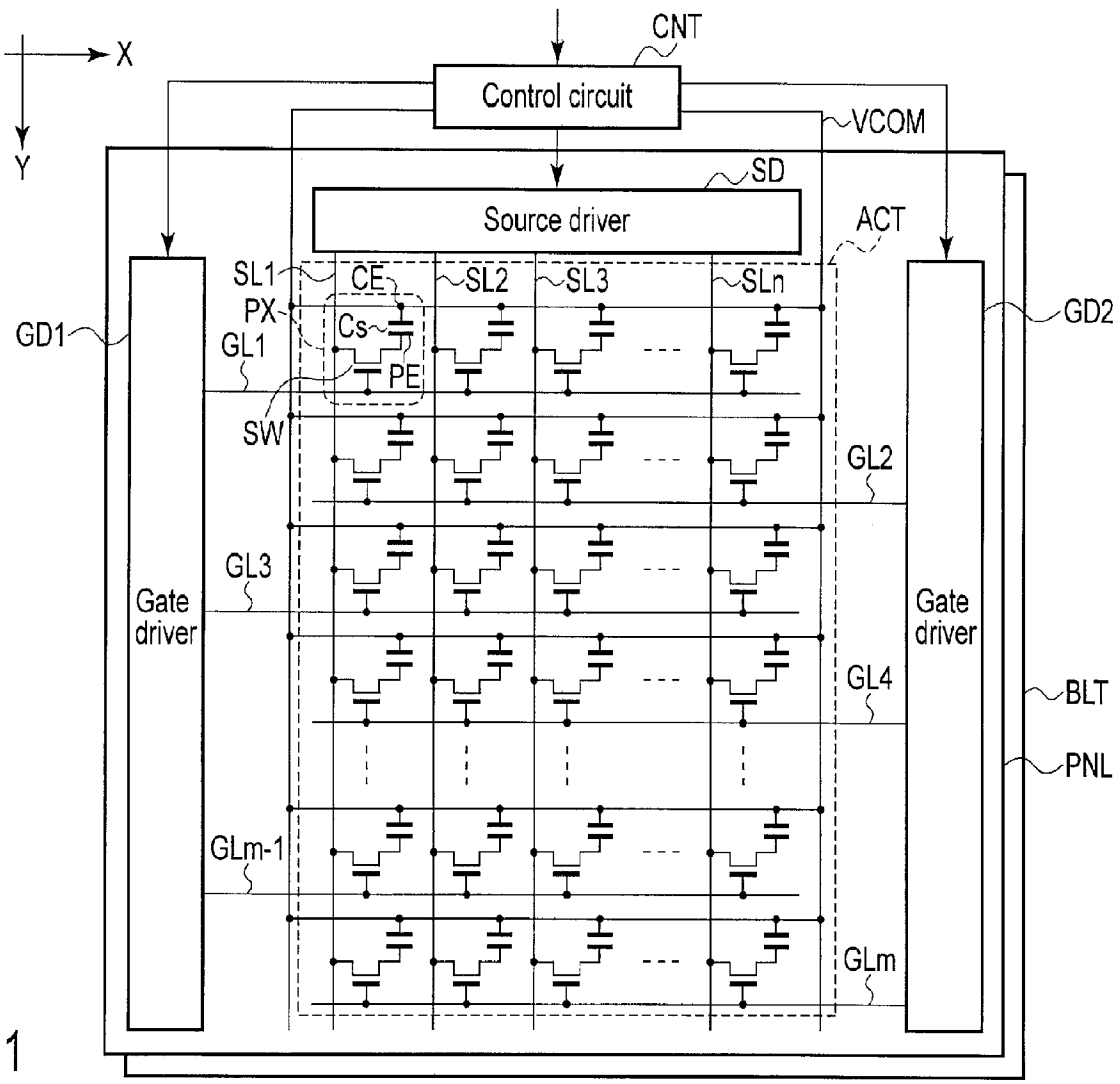
FIG. 1 schematically shows a structure of a display device according to an embodiment.

FIG. 1 schematically shows a structure of a display device according to an embodiment.

The display device comprises a display panel PNL of active matrix type, a driving portion which supplies a signal for displaying an image to the display panel PNL, and a backlight unit BLT which illuminates the display panel PNL.

As described later, the display panel PNL is a liquid crystal display panel in which a liquid crystal layer is retained between a pair of substrates. The display panel PNL comprises an active area (display area) ACT which displays an image. The active area ACT includes a plurality of pixels PX arrayed in a matrix. In the active area ACT, the display panel PNL comprises m gate lines GL (GL1 to GLm), n source lines SL (SL1 to SLn), etc., where m and n are positive integers. For example, the gate lines GL extend along a first direction X and are arranged in a second direction Y. The source lines SL extend along the second direction Y and are arranged in the first direction X. The gate lines GL or the source lines SL may not be formed linearly. Each of the gate lines GL and the source lines SL may be partially bended. The gate lines GL and the source lines SL may partially branch off.

The driving portion comprises gate drivers GD, a source driver SD and a control circuit CNT. At least a part of the gate drivers GD and the source driver SD is formed on the display panel PNL. The control circuit CNT is provided in a driving IC chip mounted on the display panel PNL, a flexible printed circuit board, etc.

The gate lines GL extend to the outside of the active area ACT and are electrically connected to the gate drivers GD (GD1 and GD2). In the example shown in the figure, odd-numbered gate lines GL are connected to gate driver GD1. Even-numbered gate lines GL are connected to gate driver GD2. The source lines SL extend to the outside of the active area ACT and are electrically connected to the source driver SD. The structures of the gate drivers GD and the source driver SD are not limited to the example shown in the figure.

Each pixel PX comprises a switching element SW, a pixel electrode PE, a common electrode CE, etc. The switching element SW is composed of, for example, an re-channel thin-film transistor. The switching element SW is electrically connected to the gate line GL and the source line SL. The pixel electrode PE is electrically connected to the switching element SW. The common electrode CE is provided so as to be common to the pixel electrodes PE of a plurality of pixels PX. Capacitance is formed between the common electrode CE and each pixel electrode PE and retains an image signal (voltage) which is necessary for display of the pixel PX.

In the example shown in the FIG. 1, the active area ACT is composed of m lines (m gate lines) arranged in the second direction Y. Each line is composed of n pixels PX arranged in the first direction X and is electrically connected to the same gate line GL. Thus, each gate line GL intersects with n source lines SL. Each line comprises n switching elements SW and n pixel electrodes PE. The switching elements SW are electrically connected to one gate line GL and the respective source lines SL. The pixel electrodes PE are electrically connected to the respective switching elements SW. The connection relationship of the pixels PX in the active area ACT is not limited to the example shown in the figure.

The control circuit CNT generates various types of signals which are necessary to display an image in the active area ACT based on an external signal supplied from an external signal source, and outputs the signals to the gate drivers GD and the source driver SD. The control circuit CNT applies a common potential (VCOM) to the common electrode CE. The gate drivers GD supply a scan signal to each gate line GL. The source driver SD supplies an image signal to each source line SL. Based on the scan signal supplied to each gate line GL, the switching elements SW connected to the same gate line GL are made conductive. Thus, image signals from the source driver SD can be written to the pixels PX of one line. When image signals are supplied to source lines SL in a state where the switching elements SW of one line are conductive, the image signals are supplied to the pixel electrodes PE via the switching elements SW which are in a conductive state. As this way, in each of the pixels PE, an electrical field is formed in accordance with the difference between the potential of the pixel electrode PE and the potential of the common electrode CE. The direction of alignment of liquid crystal molecules contained in the liquid crystal layer is controlled by the electrical field formed between the pixel electrode PE and the common electrode CE. The image signal written to each pixel PX is retained by the capacitance between the pixel electrode PE and the common electrode CE until the next image signal is written.

When an image such as a moving or still image is displayed in the active area ACT, the driving portion supplies a scan signal to the gate lines GL in series for each frame period and supplies an image signal to the source line SL. However, when a still image or a moving image having a small movement is displayed in the active area ACT, the driving portion supplies a scan signal to the gate lines GL and supplies an image signal to the source line SL with a frame frequency less than a normal frame frequency (intermittent driving). For example, when the normal frame frequency which is used when a moving image is displayed in the active area ACT is 60 Hz, the driving portion allocates sixty frame periods to one second and writes an image signal to all the pixels PX of the active area ACT in one frame period of 1/60 s. When the frame frequency which is used in intermittent driving is 1 Hz, the driving portion allocates one frame period to 1/60 s out of one second and writes an image signal to all the pixels PX of the active area ACT. At this time, each pixel PX retains the written image signal for the remaining 59/60 s. It is possible to reduce the consumed power of the display device by performing intermittent driving in which the frame frequency is decreased.

Here, the explanation of the detailed structure of the display panel PNL is omitted. A structure compatible with a twisted nematic (TN) mode, an optically compensated bend (OCB) mode, a vertically aligned (VA) mode, an in-plane switching (IPS) mode, a fringe-field switching (FFS) mode, etc., may be applied to the display panel PNL.

The display panel PNL may be structured as a transmissive panel which displays an image by selectively transmitting light from the backlight unit BLT provided on the back side of the display panel PNL as shown in the example of the figure. The display panel PNL may be structured as a reflective panel which displays an image by selectively reflecting outside light incident on the display panel PNL. The display panel PNL may be structured as a semi-transmissive panel in which transmissive and reflective types are combined with each other.

Various forms are applicable to the backlight unit BLT. The explanation of the detailed structure is omitted.

Figure 2:
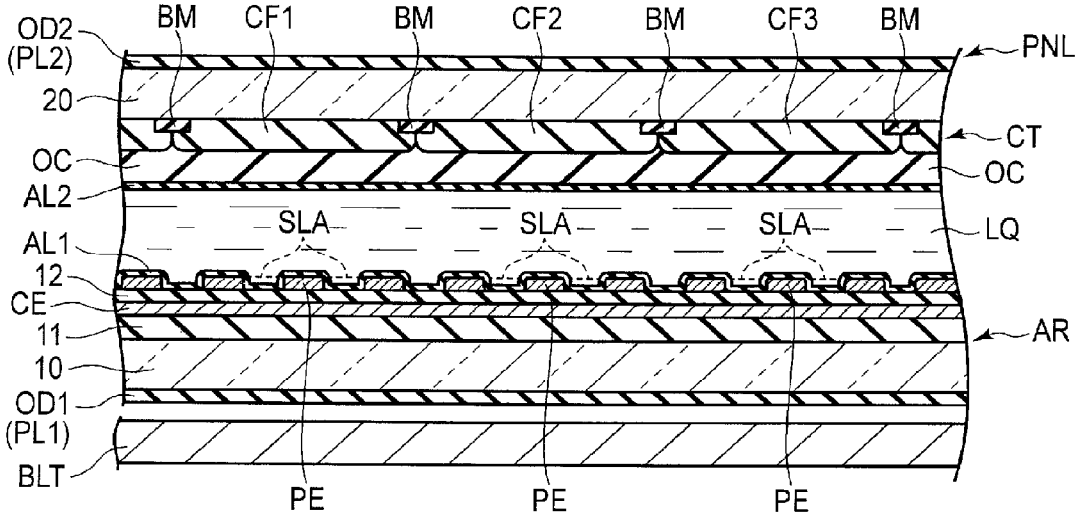
FIG. 2 schematically shows a cross-sectional surface of a display panel PNL shown in FIG. 1.

FIG. 2 schematically shows a cross-sectional surface of the display panel PNL shown in FIG. 1. Here, as an example, a display panel PNL to which an FFS mode is applied is explained.

The display panel PNL comprises an array substrate AR as a first substrate, a counter-substrate CT as a second substrate, and a liquid crystal layer LQ retained between the array substrate AR and the counter-substrate CT.

The array substrate AR comprises a first insulating substrate 10, a first insulating film 11, a common electrode CE, a second insulating film 12, a pixel electrode PE, a first alignment film AL1, etc. In the following explanation of the array substrate AR, the upper side refers to a side close to the counter-substrate CT.

The first insulating substrate 10 is formed of an insulating material having a light transmission property such as a glass substrate or a resin substrate. The first insulating film 11 is formed on the first insulating substrate 10. For example, a gate line, a source line and a switching element (not shown) are formed between the first insulating substrate 10 and the first insulating film 11. The common electrode CE is formed on the first insulating film 11. The common electrode CE is formed of a conductive material which is transparent such as indium tin oxide (ITO) or indium zinc oxide (IZO). The common electrode CE is covered by the second insulating film 12. The pixel electrode PE is formed on the second insulating film 12 and faces the common electrode CE. A slit SLA is formed to the pixel electrode PE. The pixel electrode PE is formed of a conductive material which is transparent such as TIO or IZO. The first alignment film AL1 covers the pixel electrode PE and is also formed on the second insulating film 12. The first alignment film AL1 is formed of a material showing horizontal alignment and is provided on a surface of the array substrate AR in contact with the liquid crystal layer LQ.

The counter-substrate CT comprises a second insulating substrate 20, a light-shielding layer BM, color filters CF1 to CF3, an overcoat layer OC, a second alignment film AL2, etc. The second insulating substrate 20 is formed of an insulating material having a light transmission property such as a glass substrate or a resin substrate. The light-shielding layer BM is formed on an inner surface of the second insulating substrate 20, facing the array substrate AR. The color filters CF1 to CF3 are formed on the inner surface of the second substrate 20. The end portions of the color filters CF1 to CF3 overlap the light-shielding layers BM. Each of the color filters CF1 to CF3 is formed of a resin material dyed in a different color. The overcoat layer OC covers the color filters CF1 to CF3. The second alignment film AL2 covers the overcoat layer OC. The second alignment film AL2 is formed of a material showing horizontal alignment and is provided on a surface of the counter-substrate CT in contact with the liquid crystal layer LQ.

The liquid crystal layer LQ is enclosed between the first alignment film AL1 of the array substrate AR and the second alignment film AL2 of the counter-substrate CT.

A first optical element OD1 including a first polarizer PL1 is attached to the array substrate AR. A second optical element OD2 including a second polarizer PL2 is attached to the counter-substrate CT. The first optical element OD1 and the second optical element OD2 may include other optical elements such as a retardation plate.

Figure 3:
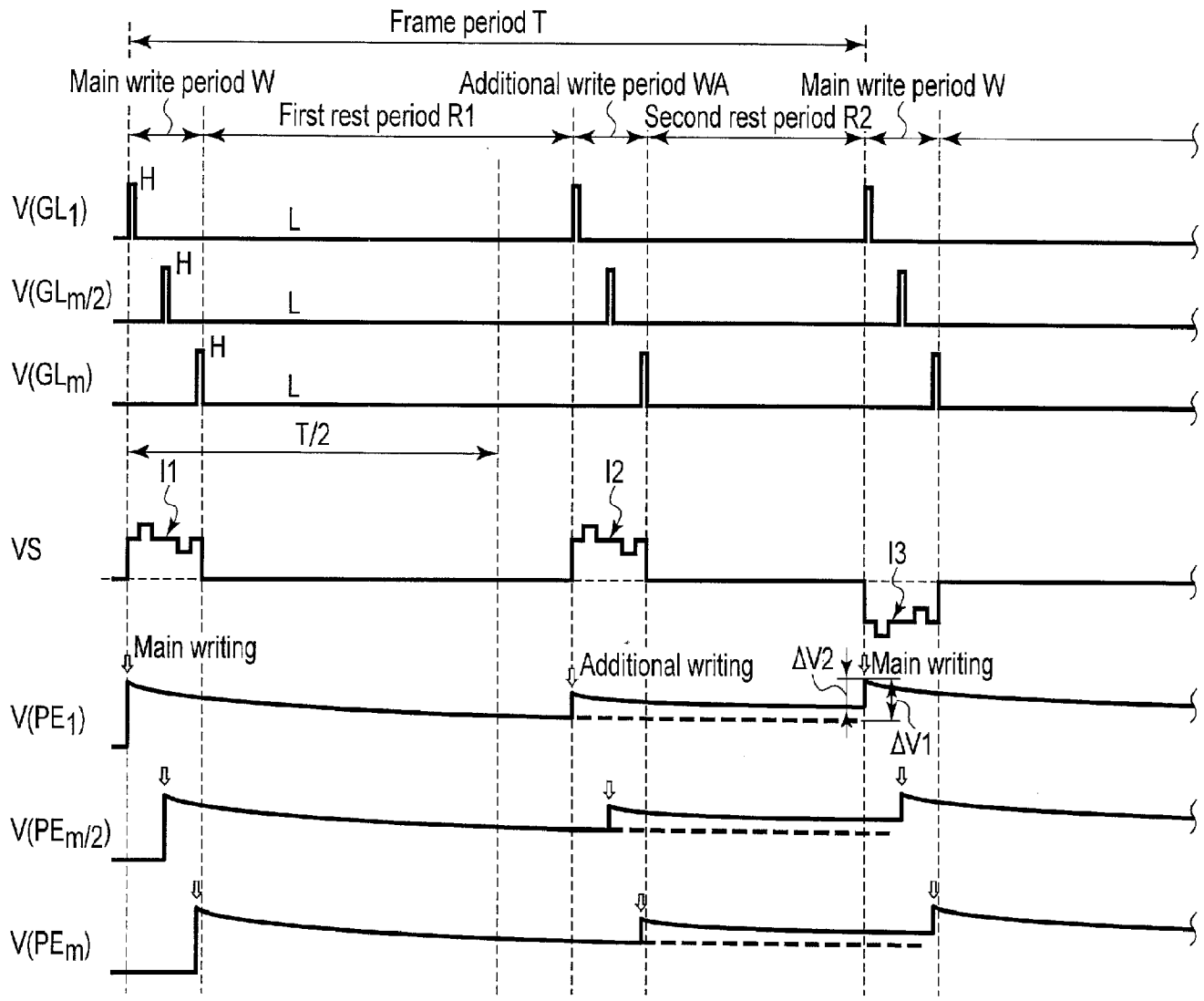
FIG. 3 shows an example of a timing chart for writing an image signal to each pixel PX of an active area ACT.

FIG. 3 shows an example of a timing chart for writing an image signal to each pixel PX of the active area ACT.

V(GL1), V(GLm/2) and V(GLm) in the figure correspond to the scan signals supplied to the gate line GL1, the gate line GLm/2 and the gate line GLm, respectively. The gate line GL1 is located on the one end side of the active area ACT. The gate line GLm/2 is located in the middle part of the active area ACT. The gate line GLm is located on the other end side of the active area ACT. The figure shows that, when the pulse is high (H) in each scan signal, the switching elements connected to each gate line are conductive. When the pulse is low (L), the switching elements connected to each gate line are not conductive. In the following explanation, the phrase "a gate line GL is selected" indicates that the switching elements connected to the gate line GL are made conductive by the gate driver GD through supply of a high scan signal to the gate line GL.

VS in the FIG. 3 corresponds to an image signal supplied to one source line SL. The image signal includes a first image signal I1, a second image signal I2 and a third image signal I3 as explained later. The source line SL intersects with the gate line GL1, the gate line GLm/2 and the gate line GLm.

V(PE1), V(PEm/2) and V(PEm) in the FIG. 3 correspond to the absolute values of the differences in potential between the common electrode and the pixel electrode PE1, the pixel electrode PEm/2 and the pixel electrode PEm, respectively. The pixel electrode PE1 is electrically connected to the switching element connected to the gate line GL1 and the source line SL. The pixel electrode PEm/2 is electrically connected to the switching element connected to the gate line GLm/2 and the source line SL. The pixel electrode PEm is electrically connected to the switching element connected to the gate line GLm and the source line SL. The present embodiment is explained below, including a case to which a driving method of inverting the polarity (in other words, a method of driving the liquid crystal layer with alternate current) for each frame is applied.

One frame period T includes a main write period W, a first rest period R1, an additional write period WA and a second rest period R2. The rest period may be called a hold period.

The main write period W is equivalent to a period in which the active area ACT is scanned. In the main write period W, the first image signal I1 corresponding to the image which should be displayed essentially is written to all the pixels PX of the active area ACT. In the main write period W, a scan signal is supplied in series from the gate drivers GD to m gate lines GL of the active area ACT. Thus, the switching elements connected to each gate line GL are made conductive. At this time, the first image signal I1 supplied to the source lines SL is supplied to each pixel electrode via the switching elements. In the example shown in the FIG. 3, at the time point when the pulse of the scan signal V(GL1) of the gate line GL1 rises, the first image signal I1 supplied to the source line SL is supplied to the pixel electrode PE1. Subsequently, at the time point when the pulse of the scan signal V(GLm/2) of the gate line GLm/2 rises, the first image signal I1 supplied to the source line SL is supplied to the pixel electrode PEm/2. Subsequently, at the time point when the pulse of the scan signal V(GLm) of the gate line GLm rises, the first image signal I1 supplied to the source line SL is supplied to the pixel electrode PEm. In this manner, the first image signal I1 is written to each pixel PX. The first image signal I1 written to each pixel PX is retained until the next image signal is written. In the example shown in the figure, the main write period W is equivalent to a period from the time point when the pulse of the scan signal V(GL1) of the gate line GL1 rises to the time point when the pulse of the scan signal V(GLm) of the gate line GLm falls.

The first rest period R1 subsequent to the main write period W is a period in which m gate lines GL of the active area ACT are in a non-scan state concurrently. In the first rest period R1, an image signal is not written to any pixel PX of the active area ACT. Thus, in the first rest period R1, each pixel PX retains the first image signal I1 which has been written in the main write period W. In the example shown in the FIG. 3, the first rest period R1 is equivalent to a period from the time point when the pulse of the scan signal V(GLm) of the gate line GLm falls in the main write period W to the time point when the pulse of the scan signal V(GL1) of the gate line GL1 rises in the additional write period WA explained below.

The additional write period WA subsequent to the first rest period R1 is equivalent to a period in which the active area ACT is scanned. In the additional write period WA, the second image signal I2 is additionally written to all the pixels PX of the active area ACT. The second image signal I2 which is additionally written is a signal corresponding to the first image signal I1, and may be the same image signal as the first image signal I1. The second image signal I2 may be a signal having a voltage less than that of the first image signal I1. The relationship between the first image signal I1 and the second image signal I2 is explained in detail later. In the additional write period WA, in a manner similar to that of the main write period W, a scan signal is supplied in series from the gate drivers GD to m gate lines GL of the active area ACT. In this manner, the switching elements connected to each gate line GL are made conductive. At this time, the second image signal I2 supplied to the source lines SL is supplied to each pixel electrode via the switching elements. In the example shown in the figure, at the time point when the pulse of the scan signal V(GL1) of the gate line GL1 rises, the second image signal I2 supplied to the source line SL is supplied to the pixel electrode PE1. Subsequently, at the time point when the pulse of the scan signal V(GLm/2) of the gate line GLm/2 rises, the second image signal I2 supplied to the source line SL is supplied to the pixel electrode PEm/2. Subsequently, at the time point when the pulse of the scan signal V(GLm) of the gate line GLm rises, the second image signal I2 supplied to the source line SL is supplied to the pixel electrode PEm. In this manner, the second image signal I2 is written to each pixel PX. The second image signal I2 written to each pixel PX is retained until the next image signal is written. In the example shown in the FIG. 3, the additional write period WA is equivalent to a period from the time point when the pulse of the scan signal V(GL1) of the gate line GL1 rises to the time point when the pulse of the scan signal V(GLm) of the gate line GLm falls.

The second rest period R2 subsequent to the additional write period WA is a period in which m gate lines GL of the active area ACT are in a non-scan state concurrently. In the second rest period R2, an image signal is not written to any pixel PX of the active area ACT. Thus, in the second rest period R2, each pixel PX retains the second image signal I2 which has been written in the additional write period WA. In the example shown in the FIG. 3, the second rest period R2 is equivalent to a period from the time point when the pulse of the scan signal V(GLm) of the gate line GLm falls in the additional write period WA to the time point when the pulse of the scan signal V(GL1) of the gate line GL1 rises in the main write period W of the next frame period described below.

The main write period W of the next frame period is equivalent to a period in which the active area ACT is scanned. In the main write period W of the next frame period, the third image signal I3 corresponding to the image which should be displayed essentially is written to all the pixels PX of the active area ACT. The image signal I3 is an image signal corresponding to the next frame of the image signal I1. However, when a still image is displayed, the third image signal I3 is a signal equivalent to the first image signal I1.

In one frame period T, a time which is equal to or longer than the main write period W is allocated to the additional write period WA. The length of the additional write period WA is set in accordance with the number of times of additional writing. As shown in the example of the FIG. 3, when additional writing is performed once in the additional write period WA (in other words, when all of m gate lines GL are selected once for each gate line GL), the length of the additional write period WA is equal to that of the main write period W. In this case, for example, each of the main write period W and the additional write period WA is 1/60 s. When additional writing is performed a plurality of times in the additional write period WA (in other words, when all of m gate lines GL are selected a plurality of times for each gate line GL), the additional write period WA is longer than the main write period W. For example, when the number of times of additional writing is p (p is an integer greater than or equal to two), the main write period W is 1/60 s while the additional write period WA is p/60 s.

In one frame period T, a time which is longer than the main write period W is allocated to the first rest period R1 and the second rest period R2. The first rest period R1 is set longer than the second rest period R2. Thus, the additional write period WA is started in the latter half of the frame period T (in other words, started after the passage of a time longer than T/2 from the start of the main write period W).

In the example of the FIG. 3, when additional writing is not performed without setting the additional write period WA, the potential V(PE1) of the pixel electrode PE1 is decreased gradually over time as shown by the broken line. Thus, a relatively large difference ΔV1 in potential is generated when the third image signal I3 equivalent to the first image signal I1 is supplied to the pixel electrode PE1 in the main write period W of the next frame period. This phenomenon is also seen in the potential of the other pixel electrodes. Thus, in the image displayed in the active area ACT, the difference in luminance is easily recognized as a flicker because of the difference in potential between the frames of the pixels PX.

In the present embodiment, the second image signal I2 is additionally written in the additional write period WA. Therefore, the reduction in potential of the first image signal I1 retained by each pixel is prevented, or the potential is restored to a level close to that of the potential of the first image signal I1 which has been written in the main write period W. Thus, the difference ΔV2 in potential which is generated when the third image signal I3 equivalent to the first image signal I1 is written to each pixel PX in the main write period W of the next frame period is less than the difference ΔV1 in potential. In this manner, the difference in luminance of the displayed image is difficult to be recognized as a flicker.

In particular, this type of additional writing is preferably performed at a time point when the reduction in potential of the image signal retained by each pixel PX is dramatic. Since the potential of the retained image signal is decreased gradually as time passes, additional writing is preferably started in the latter half of one frame period T. In this manner, it is possible to further reduce the difference in potential from the image signal written in the next frame period. Thus, the difference in luminance of the image can be further reduced.

Even when the frame frequency is reduced, the difference in luminance is difficult to be recognized as a flicker in the displayed image. Thus, it is possible to reduce the consumed power and prevent the degradation of the display quality.

Even when the polarity of the third image signal I3 is different from that of the first image signal I1, by applying additional writing in a frame period, the difference in the absolute value is made small between the potential of the image signal in the latter half of the frame period and the potential of the image signal which is used when the main writing is performed in the next frame period. Thus, the difference in luminance between frames is reduced. In this manner, the flicker is decreased.

When additional writing is performed a plurality of times for each pixel PX in the additional write period WA, the additional write period WA may be started before the passage of T/2 from the start of a first scan period S1.

Now, this specification looks at a gate line (GL1) and the pixel electrode (PE1) connected to the gate line (GL1) in the active area.

Figure 4:
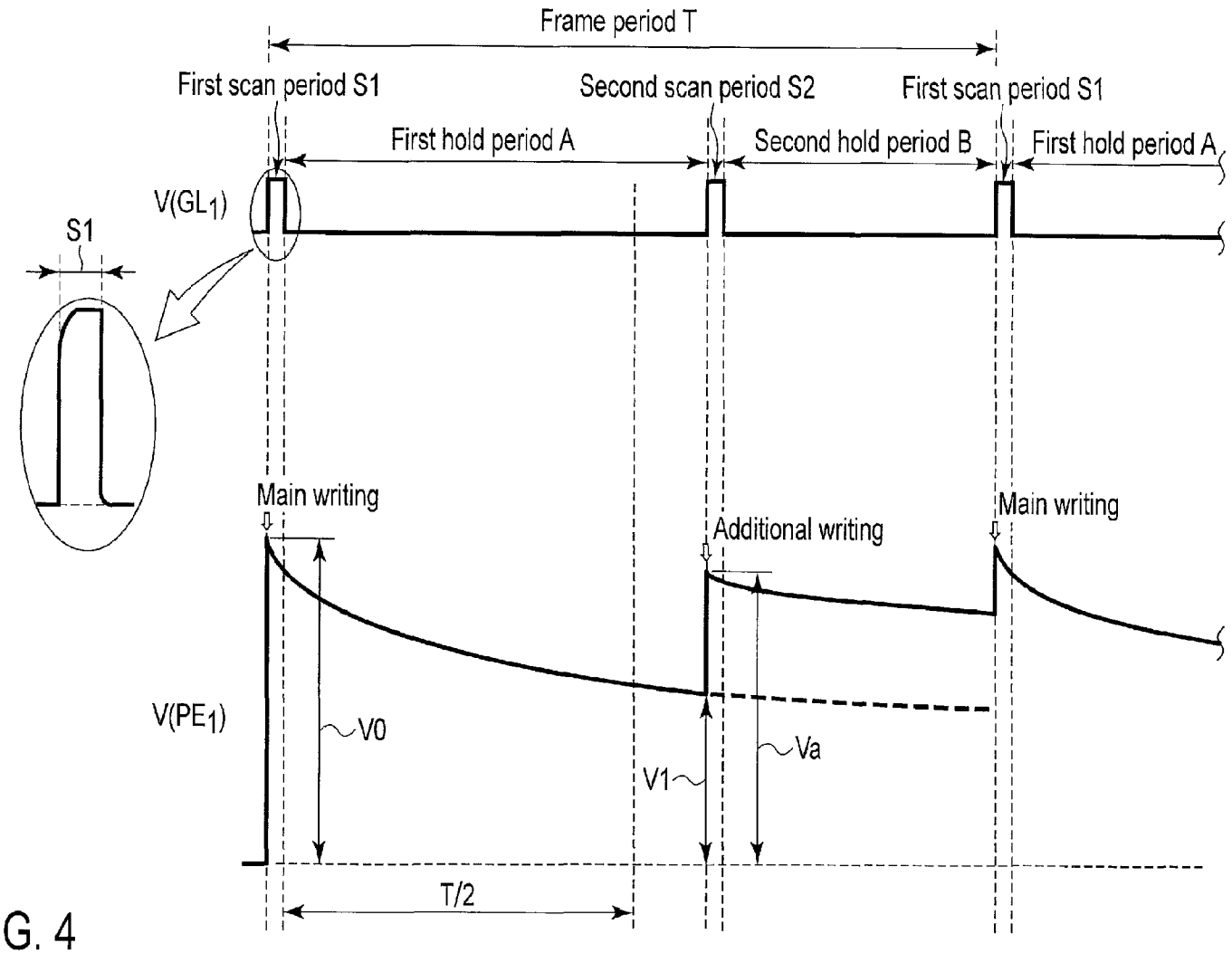
FIG. 4 shows an example of a timing chart for writing an image signal to the pixel PX comprising a pixel electrode PE1.

FIG. 4 shows an example of a timing chart for writing an image signal to the pixel PX the having pixel electrode PE1.

One frame period T comprises the first scan period S1, a first hold period A, a second scan period S2 and a second hold period B.

The first scan period S1 is equivalent to a period in which an image signal corresponding to the image to be displayed essentially is written to all the pixels PX electrically connected to the gate line GL1. In the first scan period S1 in which the gate line GL1 is selected by the gate driver GD, the switching elements connected to the gate line GL1 are made conductive, and an image signal is supplied to the pixel electrode PE1. The first scan period S1 is included in the above main write period W. When the main write period W in which a scan signal is supplied in series to m gate lines GL is 1/60 s, the first scan period S1 is less than or equal to (1/60)·(1/m) s. For example, the first scan period S1 is the period from the time point when the pulse of the scan signal V(GL1) rises to the time point when the pulse falls, the peak time of the pulse of the scan signal V(GL1), or the period in which the pulse of the scan signal V(GL1) is greater than or equal to a threshold voltage for making the switching elements connected to the gate line GL1 conductive.

In the FIG. 4, a part of the scan signal V(GL1) is enlarged. Although the form of the pulse is substantially rectangular in an example, the waveform tends to bend until the pulse reaches the peak at the time of rising, and until the pulse reaches the bottom at the time of falling. In this type of pulse waveform, the first scan period S1 can be defined as a period from the time point when the pulse waveform rises from the bottom rapidly to the time point when the pulse waveform falls from the peak rapidly.

The first hold period A subsequent to the first scan period S1 is equivalent to a period in which the image signal written to each pixel PX is retained. The first hold period A includes the above first rest period R1 and the period in which the other gate lines are selected in the main write period W. For example, the first hold period A is equivalent to a period from the time point when the pulse of the scan signal V(GL1) falls in the first scan period S1 to the time point when the pulse of the scan signal V(GL1) rises in the second scan period S2 described later.

The second scan period S2 subsequent to the first hold period A is equivalent to a period in which an image signal is additionally written to all the pixels PX electrically connected to the gate line GL1. In the second scan period S2 in which the gate line GL1 is selected by the gate driver GD, the switching elements connected to the gate line GL1 are conductive, and an image signal is supplied to the pixel electrode PE1. The second scan period S2 is included in the above additional write period WA. In the second scan period S2, the gate line GL1 is selectable once or more times. When the gate line GL1 is selected only once as exemplarily shown in the FIG. 4, the time can be defined in the same manner as the above first scan period S1. When additional writing is performed once in the second scan period S2 (in other words, when the gate line GL1 is selected once), the length of the second scan period S2 is equal to that of the first scan period S1.

The second hold period B subsequent to the second scan period S2 is equivalent to a period in which the image signal written to each pixel PX is retained. The second hold period B includes the above second rest period R2 and the period in which the other gate lines are selected in the additional write period WA. For example, the second hold period B is equivalent to a period from the time point when the pulse of the scan signal V(GL1) falls in the second scan period S2 to the time point when the pulse of the scan signal V(GL1) rises in the next frame period described later.

The first scan period S1 of the next frame period is equivalent to a period in which an image signal corresponding to the image to be displayed essentially is written to all the pixels electrically connected to the gate line GL1.

In one frame period T, a time longer than the first scan period S1 and the second scan period S2 is allocated to the first hold period A and the second hold period B. The first hold period A is set longer than the second hold period B. In one frame period T, the second scan period S2 is close to the next frame period.

As explained with reference to FIG. 3, the potential V(PE) of the pixel electrode PE is reduced gradually over time. When the additional writing in the second scan period S2 is performed at a time point close to the next frame period, the reduction in the potential V(PE) of the pixel electrode PE is prevented. Thus, it is possible to reduce the difference in potential from the image signal written in the next frame period. In this manner, it is possible to prevent a flicker which is caused by the difference in luminance in the displayed image and prevent the degradation of the display quality.

The first hold period A is preferably set longer than the period T/2 which is a half of one frame period T. In other words, the second scan period S2 is preferably started in the latter half of one frame period T. Because of this setting, the reduction in the potential V(PE) of the pixel electrode PE can be effectively prevented.

Now, this specification explains the relationship between the image signal written in the first scan period S1 (equivalent to the above first image signal I1) and the image signal written in the second scan period S2 (equivalent to the above second image signal I2).

When the difference in potential between the pixel electrode PE1 and the common electrode CE in the first scan period S1 (in other words, the potential of the first image signal I1 written in the first scan period S1) is V0, and the difference in potential between the pixel electrode PE1 and the common electrode CE at the time of the passage of the first hold period A (in other words, the potential V(PE1) of the pixel electrode PE1 at the time of the passage of the first hold period A) is V1, and the difference in potential between the pixel electrode PE1 and the common electrode CE in the second scan period S2 (in other words, the potential of the second image signal I2 additionally written in the second scan period S2) is Va, the relationship $V1<Va\leq V0$ is preferably satisfied.

V1 can be predicted based on the frame frequency, the length of the first hold period A, the physical properties of the liquid crystal material, etc. Va needs to be set higher than V1. For example, Va is set to 90% of V0 or greater, and is preferably set to 95% of V0 or greater. When Va is excessively higher than V1, the difference in potential in additional writing is easily recognized as the difference in luminance. Therefore, Va is set to V0 or less, or is set less than V0. For example, Va is preferably set to 99% of V0 or less.

In the example shown in FIG. 4, additional writing is performed once in the second scan period S2. However, additional writing may be performed a plurality of times in the second scan period S2.

Figure 5:
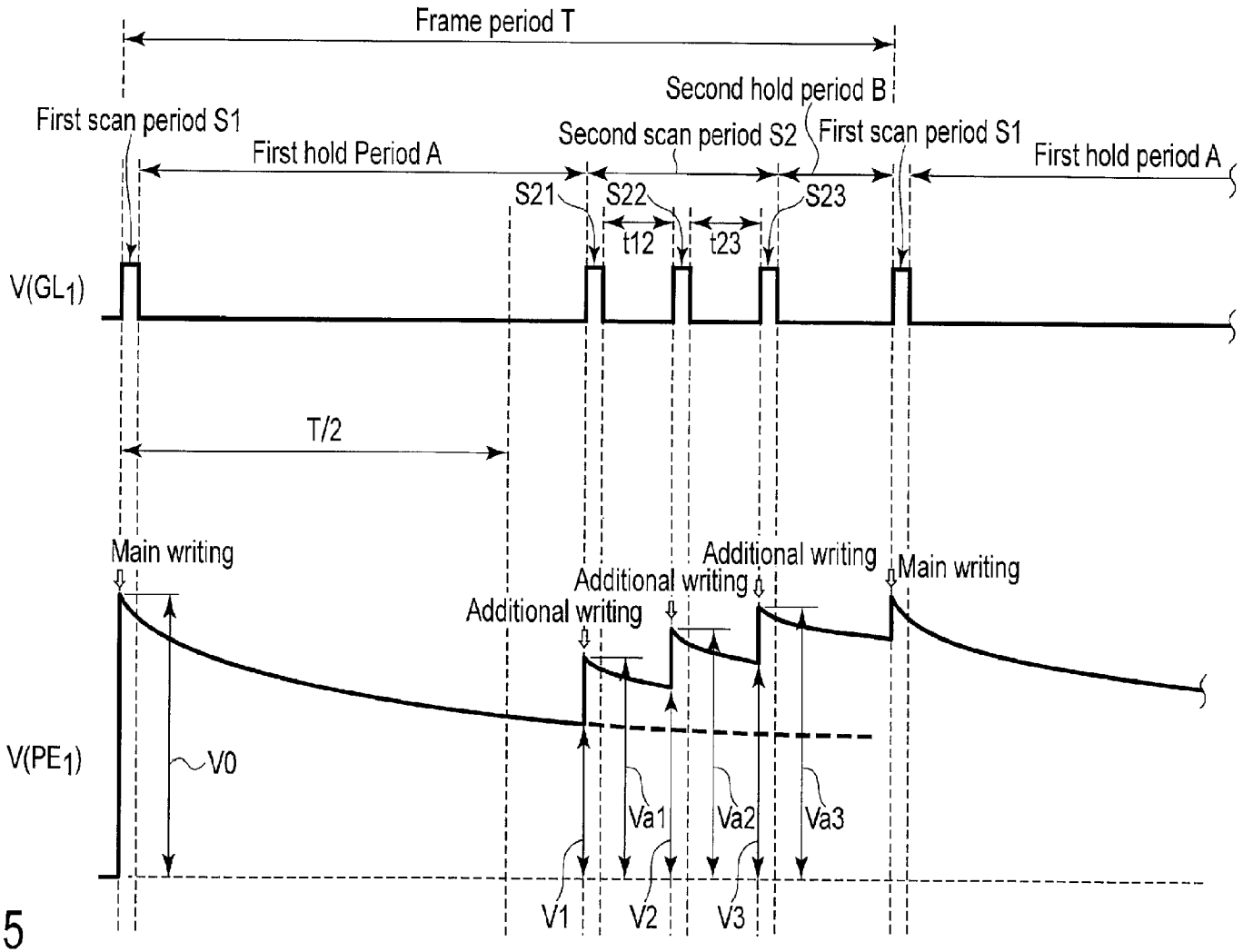
FIG. 5 shows another example of the timing chart for writing an image signal to the pixel PX comprising the pixel electrode PE1.

FIG. 5 shows another example of the timing chart for writing an image signal to the pixel PX comprising the pixel electrode PE1.

The example shown in FIG. 5 is different from that in FIG. 4 in respect that additional writing is performed a plurality of times in the second scan period S2 of one frame period T.

In a manner similar to that of the example of FIG. 4, one frame period T comprises the first scan period S1, the first hold period A, the second scan period S2 and the second hold period B.

The first scan period S1 is equivalent to a period in which an image signal corresponding to the image to be displayed essentially is written to all the pixels PX electrically connected to the gate line GL1. The image signal written to each pixel PX is retained in the first hold period A subsequent to the first scan period S1.

The second scan period S2 subsequent to the first hold period A is equivalent to a period in which an image signal is additionally written to all the pixels PX electrically connected to the gate line GL1. A time longer than the first scan period S1 is allocated to the second scan period S2. In the second scan period S2, the gate line GL1 is selected a plurality of times, and thus, additional writing is performed a plurality of times. In the example shown in the figure, additional writing is performed three times in the second scan period S2.

Specifically, the second scan period S2 includes a first period S21, a second period S22 and a third period S23. The gate line GL1 is selected by the gate driver GD in each of the first period S21, the second period S22 and the third period S23. In the first to third periods S21 to S23, the switching elements connected to the gate line GL1 are conductive. In this manner, an image signal is supplied to the pixel electrode PE1 via the switching elements which are in a conductive state. The image signal written to each pixel PX is retained in the second hold period B subsequent to the second scan period S2.

The first scan period S1 of the next frame period is equivalent to a period in which an image signal corresponding to the image to be displayed essentially is written to all the pixels PX electrically connected to the gate line GL1.

For example, the first scan period S1 is a period from the time point when the pulse of the scan signal V(GL1) rises to the time point when the pulse falls. The first hold period A is equivalent to a period from the time point when the pulse of the scan signal V(GL1) falls in the first scan period S1 to the time point when the pulse of the scan signal V(GL1) rises in the first period S21 of the second scan period S2. The second scan period S2 is equivalent to a period from the time point when the pulse of the scan signal V(GL1) rises in the first period S21 to the time point when the pulse of the scan signal V(GL1) falls in the third period S23. The second hold period B is equivalent to a period from the time point when the pulse of the scan signal V(GL1) falls in the third period S23 of the second scan period S2 to the time point when the pulse of the scan signal V(GL1) rises in the first scan period S1 of the next frame period.

In this example, similarly, the first hold period A is set longer than the second hold period B. In one frame period T, the second scan period S2 is close to the next frame period. In the example shown in the figure, the second scan period S2 is started after the passage of a time longer than T/2 from the start of the first scan period S1 (in other words, started in the latter half of the frame period T).

In the second scan period S2, the intervals of the first to third periods S21 to S23 in which the gate line GL1 is selected are shorter than the first hold period A. Specifically, an interval t12 between the first period S21 and the second period S22, and an interval t23 between the second period S22 and the third period S23 are shorter than the first hold period A. Moreover, in some cases, the interval t12 and the interval t23 may be shorter than the second hold period B. When sixty frame periods are allocated to one second, the intervals t12 and t23 are 1/60 s or greater. The length of the interval t12 may be the same as or different from that of the interval t23.

Now, this specification explains the relationship of the image signals which are written in the second scan period S2 over a plurality of times.

When the difference in potential between the pixel electrode PE1 and the common electrode CE in the first scan period S1 (in other words, the potential of the image signal written in the first scan period S1) is V0, and the difference in potential between the pixel electrode PE1 and the common electrode CE in the first period S21 in which the gate line GL1 is selected in the second scan period S2 (in other words, the potential of the image signal additionally written in the first period S21) is Va1, and the difference in potential between the pixel electrode PE1 and the common electrode CE in the second period S22 in which the gate line GL1 is selected again after the first period S21 in the second scan period S2 (in other words, the potential of the image signal additionally written in the second period S22) is Va2, the relationship $Va1 \leq Va2 \leq V0$ is preferably satisfied.

When the difference in potential between the pixel electrode PE1 and the common electrode CE in the third period S23 in the second scan period S2 (in other words, the potential of the image signal additionally written in the third period S23) is Va3, the relationship $Va1 \leq Va2 \leq V3 \leq V0$ is preferably satisfied. Each of the potentials Va1 to Va3 of the image signal which is additionally written is set higher than the potential V(PE1)=V1 of the pixel electrode PE1 at the time of the passage of the first hold period A.

When additional writing is performed a plurality of times in the second scan period S2, Va1 to Va3 are preferably set so as to get close to the potential V0 of the image signal written in the first scan period S1 in a stepwise manner relative to the reduced potential of the pixel electrode PE at the time of passage of the first hold period A. Va1 to Va3 preferably satisfy the relationship $V1 < Va1 < Va2 < V3 \leq V0$. By this setting, the difference in potential in additional writing (for example, in the figure, the difference between the potentials V1 and Va1, the difference between the potentials V2 and Va2, or the difference between the potentials V3 and Va3) can be small. It is difficult to recognize the difference in luminance which is caused by the difference in potential. In this manner, the degradation of the display quality can be prevented.

Figure 6:
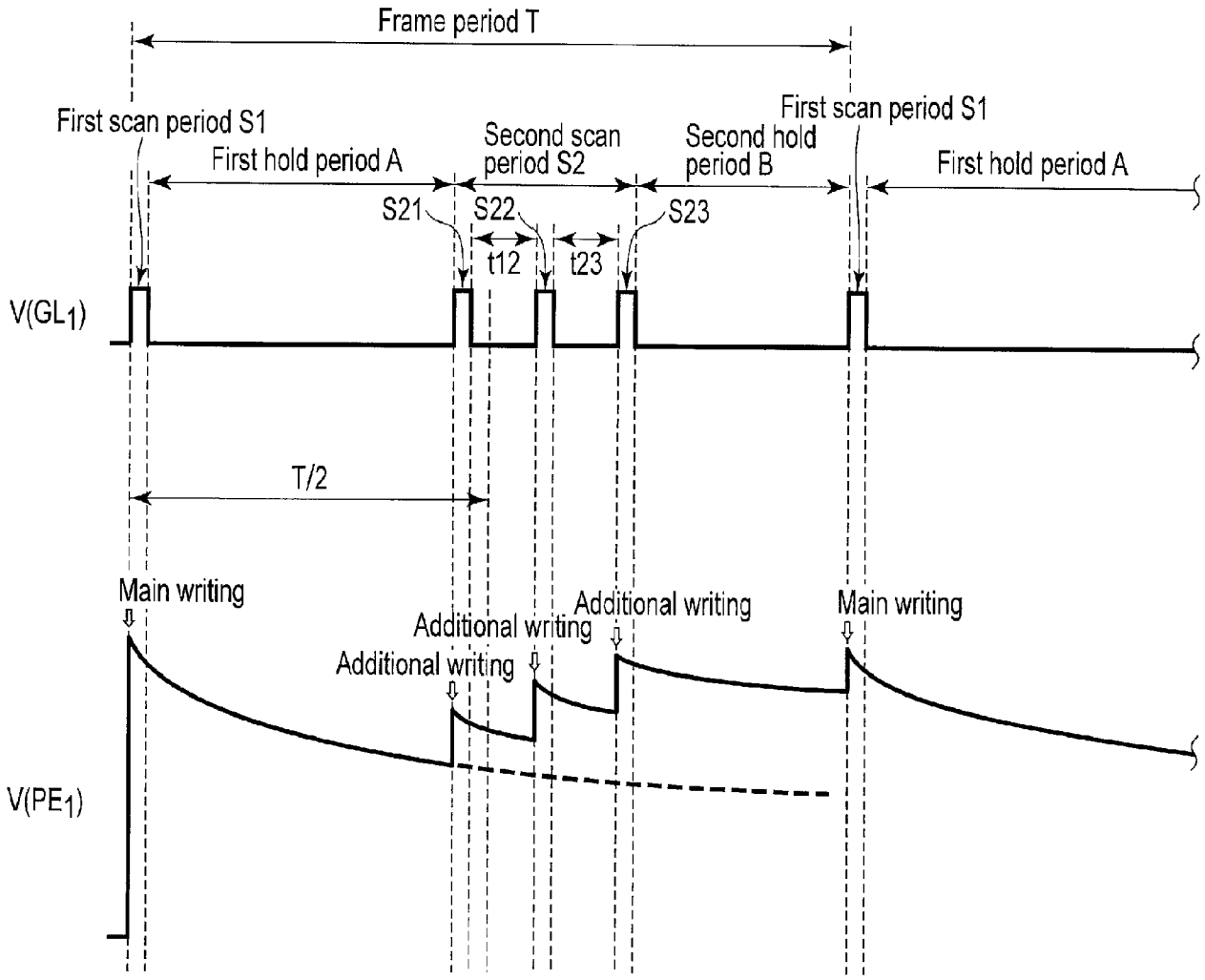
FIG. 6 shows another example of the timing chart for writing an image signal to the pixel PX comprising the pixel electrode PE1.

FIG. 6 shows another example of the timing chart for writing an image signal to the pixel PX comprising the pixel electrode PE1.

The example shown in FIG. 6 is different from that in FIG. 5 in respect that the second scan period S2 is started in the first half of one frame period. In other words, the second scan period S2 is started before the passage of the period T/2 from the start of the first scan period S1.

In this example, similarly, the first hold period A is set longer than the second hold period B. By this setting, an effect similar to that of the example of FIG. 5 is obtained. Since the consumed power is increased as the number of times of additional writing is increased, the number of times of additional writing in the second scan period S2 is preferably ten at a maximum when sixty frames are allocated to one second.

As explained above, according to the present embodiment, it is possible to provide a display device which is capable of reducing the consumed power and preventing the degradation of the display quality.

Some examples of other display devices which are obtained by the structures disclosed in this specification are additionally described below.

(1) A display device comprising:

a display panel comprising an active area; and a driving portion which supplies a signal for displaying an image to the display panel, wherein the driving portion writes a first image signal to each pixel in a first main write period in which the active area is scanned, the driving portion writes a second image signal to each pixel in an additional write period in which the active area is scanned after the first main write period, the driving portion writes a third image signal to each pixel in a second main write period in which the active area is scanned after the additional write period, a first rest period in a non-scan state is provided between the first main write period and the additional write period, and a second rest period in a non-scan state is provided between the additional write period and the second main write period, and the first rest period is longer than the second rest period.

(2) The display device of the above (1), wherein a period from start of the main write period to start of the additional write period is longer than a half of a frame period.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device comprising:

a display panel including a gate line, a plurality of source lines intersecting with the gate line, and a plurality of switching elements electrically connected to the gate line and the respective source lines; and a driving portion including a gate driver which selects the gate line by supplying a predetermined voltage to the gate line, and a source driver which supplies image signals to the source lines for each frame period, wherein the image signals are supplied from the connected source lines to pixel electrodes through the switching elements connected to the gate line selected by the gate driver, the frame period comprises a first scan period in which the gate line is selected by the gate driver, a first hold period subsequent to the first scan period, a second scan period in which the gate line is selected by the gate driver at least once subsequent to the first hold period, and a second hold period subsequent to the second scan period, the first hold period is longer than the second hold period, and when a difference in potential between the pixel electrode and a common electrode in the first scan period is V0, and a difference in potential between the pixel electrode and the common electrode at a time of passage of the first hold period is V1, and a difference in potential between the pixel electrode and the common electrode in the second scan period is Va, a relationship $V1<Va\leq V0$ is satisfied, wherein V0, V1 and Va are real numbers.

2. The display device of claim 1, wherein the first hold period is longer than a half of the frame period.

3. The display device of claim 1, wherein the second scan period includes a first period in which the gate line is selected, and a second period in which the gate line is selected again, and an interval between the first period and the second period is shorter than the first hold period.

4. The display device of claim 1, wherein the V0 is greater than the Va.

5. The display device of claim 4, wherein the Va is greater than or equal to 90% of the V0.

6. The display device of claim 1, wherein when a difference in potential between the pixel electrode and a common electrode in the first scan period is V0, and a difference in potential between the pixel electrode and the common electrode in a first period in which the gate line is selected in the second scan period is Va1, and a difference in potential between the pixel electrode and the common electrode in a second period in which the gate line is selected again subsequent to the first period in the second scan period is Va2, a relationship $Va1\leq Va2\leq V0$ is satisfied.

* * * * *